US005752703A

United States Patent [19]

Wong

[11] Patent Number: 5,752,703

[45] Date of Patent: May 19, 1998

[54] PROJECTILE-TARGET GAME OF SKILL

[76] Inventor: Howard W. K. Wong, 18414 Wakecrest Dr., Malibu, Calif. 90265

[21] Appl. No.: 265,787

[22] Filed: Jun. 27, 1994

[51] Int. Cl.[6] ..... A63F 3/02

[52] U.S. Cl. ..... 273/342

[58] Field of Search ..... 273/353, 354, 273/87.2, 313, 129 R, 85 R, 88, 440, 398, 349, 400, 402, 410

[56] References Cited

U.S. PATENT DOCUMENTS

| | | | |
|---|---|---|---|
| 1,576,515 | 3/1926 | Kinney | 273/399 |
| 5,423,552 | 6/1995 | English | 273/353 |

*Primary Examiner*—V. Millin
*Assistant Examiner*—Charles W. Anderson

[57] ABSTRACT

A table top game where attempts are made to propel a ball or other playing piece into a container or cup with the aid of a game board. A dual use game board has a generally square portion oppositely opposed to a generally rectangular portion. Present in the square and rectangular portions are two oppositely opposed tabs. Each of the tabs may fit into a container or cup, preferably a large soda pop cup. When the tab of the square portion is fitted into the cup, the cup may be stood upright so that the square portion forms a backboard. When the tab of the rectangular portion is fitted into the cup, the cup may be stably rested upon its side so that the rectangular portion forms a ramp. A first embodiment of a game piece has a flexible slat with a central spring, a post, and a bail. A ball or other projectile may be placed into the bail so that when the slat is flicked, the ball is propelled towards the upright cup with its backboard. A second embodiment of a game piece also has a flexible slat with a central spring. When a ball or other projectile is placed adjacent to one end, the slat may be flicked to swat the ball towards the side-laying cup with its ramp.

14 Claims, 1 Drawing Sheet

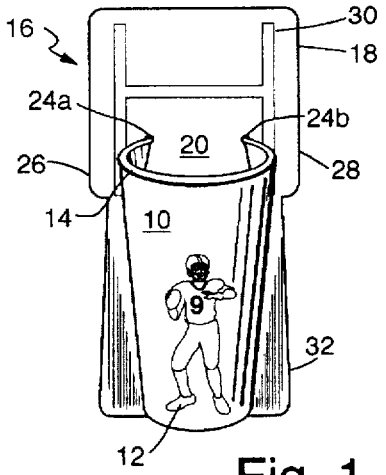
Fig. 1.
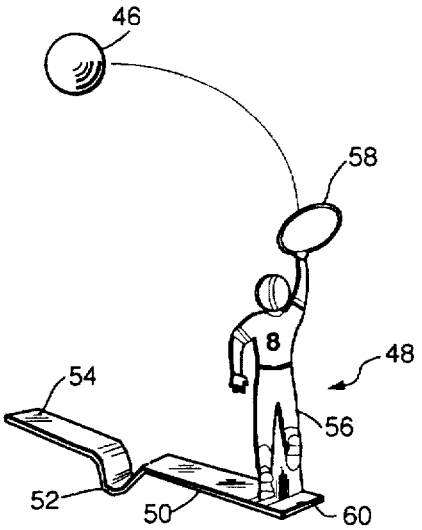
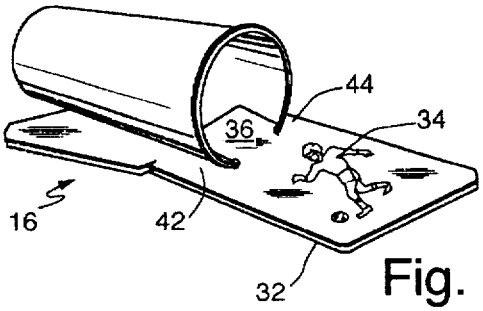
Fig. 3.
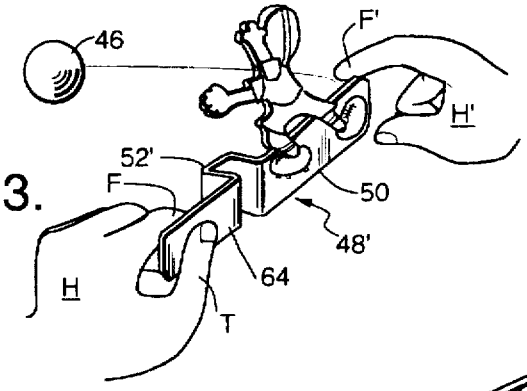
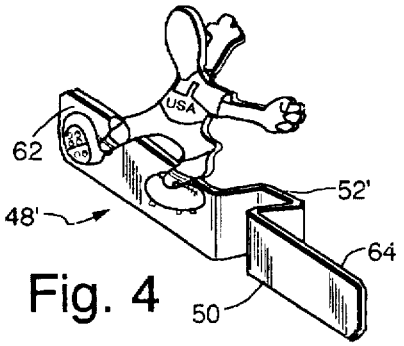
Fig. 4
Fig. 2.
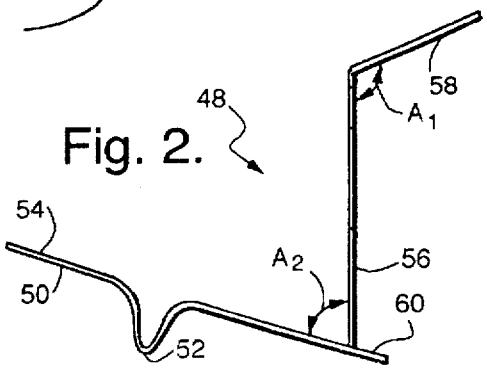
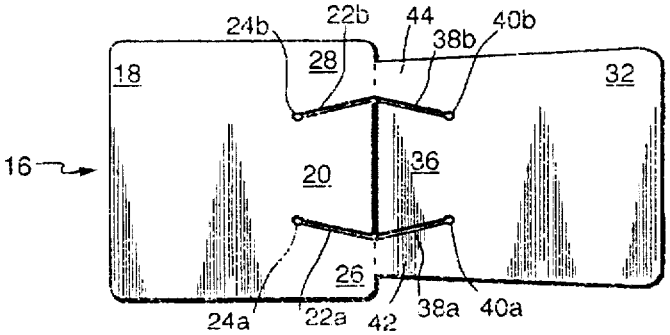
Fig. 5

PROJECTILE-TARGET GAME OF SKILL

BACKGROUND OF THE INVENTION

1. Field of the Invention

This invention relates to a game of skill where a ball or other projectile may be propelled into a cup or other container and more specifically, to such a game where a flexible game piece may be easily manipulated by the fingers of the hands to provide fun means by which such a ball may be propelled or flicked into the container using the help of a backboard or ramp to assist the ball into the cup.

2. Description of the Related Art

Many games exist where the object of the game is to place a ball or other object into a goal of some sort. Golf, hockey, football, volleyball, baseball, basketball and lacrosse all use a ball or other object to allow two competing sides to struggle for control of a ball, puck or other object. The winning team is that which sufficiently controls the ball or other object so that it can be placed or propelled into a special area protected by the opponent.

Several games have been developed that emulate the games of football, hockey, soccer, basketball, etc., for the tabletop rather than open field of play. While many of these games have been translated into electronic form for video game playing, there remains significant interest in the actual table top play in miniature. This is especially true for gratuitous items or favors that may attract an individual's interest on either a temporary or permanent basis. With the addition of attractive and interesting indicia, such games are very appealing and may elicit better enjoyment out of the game than might otherwise be experienced by the participants.

SUMMARY OF THE INVENTION

The present invention resides in a table top game that is adaptable to emulate one of several sports. Football, basketball, soccer and hockey are all adaptably represented in table top form by the present invention.

A container such as a large soda cup or the like is used as a goal into which a ball or other projectile may be propelled by a flexible game piece. The flexible game piece is engageable by human fingers to perform in a manner similar to the physical motions of players playing the actual games on an open field rather than on a table top. A game board having tabs insertable into the cup or other container is provided allowing a backboard or ramp to be formed making it easier to propel the ball into the cup. The cup, game board and flexible game piece, as well as the ball may have interesting and appealing indicia applied thereto to increase the fun and appeal in playing the game.

The flexible game piece has two portions on either side of an integrally constructed spring. The spring is formed via a large indentation made into an otherwise flat strip of flexible and resilient material, such as plastic, steel or aluminum. One side of the flexible game piece may be advantageously made longer than the other so that greater leverage can be placed upon the spring as well as providing room for noticeable indicia. In an alternative embodiment of the game piece, an angled post with an angled bail are provided so that the ball may be launched into the cup as opposed to another embodiment where the ball is swatted by the flexible game piece into the cup.

The game board of the present invention has a first generally square portion and a second generally rectangular portion oppositely and flexibly attached to one another. Near the junction where the tabs separate from the game board, apertures in the form of eyes are provided so that the game board can more constructively engage the rim of the cup. The game board may be employed with the cup in either an upright manner to emulate football and basketball games or in a manner where the cup lays on its side to emulate soccer and hockey games. The generally rectangular portion of the game board is slightly less tall than the height of the cup. The generally square portion of the game board is approximately two-thirds the height of the generally rectangular portion. The tabs of the game board portions may be cut in a manner such that the tab angles outward.

It is an object of the present invention to provide a table top game emulating several sports that use a ball, puck, or other object as the focus of the game.

It is another object of the present invention to provide a table top game that is constructed of readily available materials that is easy to play.

It is yet another object of the present invention to provide a flexible game piece by which such a game can be played.

It is also another object of the present invention to provide a game board that may be used in a plurality of manners to enhance the playing of such a game.

It is an object of the present invention to provide a flexible game piece that can advantageously use a bail in order to propel a projectile into a cup.

These and other objects and advantages of the present invention will be apparent from a review of the following specification and accompanying drawings.

BRIEF DESCRIPTION OF THE DRAWINGS

FIG. 1 shows a perspective view, one embodiment of the game of the present invention, showing the cup, the game board, the ball, and the bail-carrying flexible game piece of one embodiment.

FIG. 2 shows in schematic side view the geometry of the bail-carrying flexible game piece of FIG. 1.

FIG. 3 shows in perspective view an alternative embodiment of the present invention where the flexible game piece may propel the ball into the cup as it lays upon its side, the ball rolling up a ramp provided by the game board.

FIG. 4 shows in perspective a second embodiment of the flexible game piece with its spring and finger-gripping portion.

FIG. 5 shows in plan view the game board of the present invention with its generally square and rectangular portions, the two tabs, and the eyes where the tabs are originally formed from the generally square and rectangular portions.

DESCRIPTION OF THE PREFERRED EMBODIMENT(S)

The present invention resides in a table top game that uses a ball which is propelled into a cup. The cup may stand upright or may be laid upon its side. In order to facilitate the travel of the ball into the cup, a game board is provided that engages the cup to provide easier means by which the ball may be propelled into the cup. Also, flexible game pieces are present that allow the player to propel, by flicking or swatting, the ball into the cup. In one embodiment, the flexible game piece has a post upon which a bail is attached and serves to propel the ball upwardly into an upright cup. In a second embodiment, the flexible game piece alone can be used to propel the ball into a cup laying on its side.

As shown in FIG. 1, a container 10 such as that in the form of a large soda pop cup, may have interesting and attractive indicia 12 inscribed upon its outer surface. Cup 10 has a rim 14 that encircles the top perimeter portion of cup 10. As shown in FIG. 1, cup 10 of the present invention may have indicia on more than one side. It is contemplated that several indicia may be placed upon the cup, for example a football player on one side and a basketball player on another side. The cup should be tall enough to contain any projectile propelled into the cup, but should not be so large as to prevent the entry of such a projectile into the cup.

As also shown in FIGS. 1 and 5, a game board 16 engages container 10 at rim 14 of container 10. Game board 16 has a generally square portion 18 that forms a backboard immediately behind and above cup 10. In order to engage cup 10 about its rim 14, square portion 18 of game board 16 has a tab 20 that descends into the interior of cup 10. The side of cup 10 travels through two slits 22*a* and *b*, into the lower portion of square portion 18.

Two slits 22*a* and *b* terminate in corresponding eyes 24*a* and *b* that accommodate rim 14 of cup 10. By virtue of a slit, connecting slits 22*a* and 22*b*, these array of inter-related slits also define portions adjacent to first tab 20. As shown in FIGS. 1 and 5, a first adjacent tab 26 is shown as being left at tab 20 while a second adjoining tab 28 is shown on the right side of tab 20. First tab 20 with its adjoining portions 26 and 28 serve to engage and secure game board 16 to cup 10, when cup 10 is used in an upright manner where the mouth of the cup faces upwards.

Square portion 18 of game board 16 may have indicia 30 inscribed upon its face. As shown in FIG. 1, the indicia represent a goal post as seen upon a football playing field. The reverse side of the game board can also be used as for the side shown in FIG. 1, with the added feature of supporting alternative indicia, such as that seen on a basketball backboard.

As shown in FIG. 3, game board 16 of the present invention may be used on a relatively flat surface to usefully engage cup 10 when the cup is on its side. Rectangular portion 32 may also have indicia 34 upon its face, such as the soccer player shown in FIG. 3 or such as a hockey player that may be shown on the reverse side of rectangular portion 32. As opposed to the use of game board 16 as shown in FIG. 1, game board 16 in FIG. 3 is used as a ramp or runway over which a propelled ball may travel into side-laying cup 10.

Similar to square portion 18 of game board 16, rectangular portion 32 also has a tab 36 central to one end of rectangular portion 32. Second tab 36 is defined by two additional slits 38*a* and *b*, which terminate in corresponding eyes 40*a* and *b*. Like eyes 24*a* and *b* of square portion 18, eyes 48*a* and *b* of rectangular portion 32 serve to constructively engage rim 14 of cup 10 so that rectangular portion 32 may be secured to cup 10. Two adjacent portions 42 and 44 are defined on either side of tab 36 by slits 38*a* and *b*. As shown in FIG. 3, a third adjacent portion 42 is on the left side of tab 36, while a fourth adjacent portion 44 is shown on the right side of tab 36.

In FIG. 1, square portion 18 is shown as the primary portion of game board 16 in use. Likewise in FIG. 3, it is rectangular portion 32 that is primarily in use. However, the secondary portions of game board 16 not in primary use in FIGS. 1 and 3 also provide additional advantages to the game board of the present invention. In FIG. 1, rectangular portion 32 runs parallel to the side of cup 10. It is contemplated that eyes 24*a* and *b* are cut a such a height so that the lowest most portion of rectangular section 32 engages the surface below cup 10. This provides additional support and stability for cup 10, and can also serve to tilt cup 10 forward so that it becomes easier to propel a projectile or ball into the cup as the mouth of the cup is made more open to the player. In FIG. 3, square portion 18 rests below cup 10 as cup 10 lies on its side. As with rectangular portion 32 when it provides support for cup 10 as well as to tilt cup 10 forward (FIG. 1), underlying square portion 18 of game board 16 as shown in FIG. 3 serves to support cup 10 and to tilt it forward slightly. This also causes the front edge of rectangular portion 32 to more flatly engage the surface below it. With such flat engagement there is less of a discontinuity for a ball rolling towards the cup to encounter as it travels up the ramp formed by rectangular portion 32 and into cup 10. As the cup is preferably made of a light-weight material, it is an easy matter for tab 36 as well as underlying tab 20 to tilt cup 10, along the lines shown in FIG. 3.

The projectile for use of the game is preferably a ball as shown in FIGS. 1 and 3. Ball 46 may be a ping pong ball or other ball of similar size and weight. Ball 46 may be colored in an appealing and attractive manner to enhance the fun in playing the game.

Two types of flexible game pieces are contemplated in use with the game of the present invention. In FIGS. 1 and 2, a flexible game piece adapted to propel the ball into an upright container 10 is shown. In FIGS. 3 and 4 a flexible game piece adapted to strike or swat ball 46 so that it rolls along the ground and into container 10 as it lays upon its side is shown. While there are some general similarities to the two flexible game pieces, there are also significant differences that provide for different operation by each game piece.

Referring now to FIGS. 1 and 2, flexible game piece 48 is shown. Flexible game piece 48 has a base portion 50 in the form of a slat that has a crook or bend towards the center of slat 50. This bend 52 acts a spring and provides flexibility to slat 50 that would otherwise not be present there. One end of base 50 provides a place where slat 50 may be pressed down upon an underlying surface. This finger-pressing portion 54 is generally flat and allows the fingers of the hand to secure it temporarily to the underlying surface by downward pressure.

The other end of slat 50 is adapted to support a post 56 or other upright structure that can be configured with indicia so that it resembles a football player, a basketball player, or the like. At the top of post 56, an adjustable bail 58 in the form of a circular wire is attached to post 56. Bail 58 is circular in nature and defines a circumference slightly smaller than that of ball 46. Bail 58 lies in a plane that is at an angle $A_1$ to post 56. Likewise, post 56 is disposed at an angle $A_2$ to post support 54 at the back end of slat 50.

Angle $A_1$ between bail 58 and post 56 is approximately 67 degrees (67°) but may advantageously range from 60 to 75 degrees. Angle $A_2$ between post 56 and post support 54 is approximately 73 degrees (73°) but may advantageously range from 65 to 80 degrees.

To the rear of base slat 50, on the opposite side of spring 52, a small tail 60 is present and extends out past post 56 and its attachment to post support 54. This tail 60 provides a means by which a finger of a player's hand may engage flexible game piece 48 when other fingers press down upon finger-pressing portion 54. In this manner, when ball 46 is resting in bail 58, a quick downward force upon tail 60 can serve to flick flexible game piece 48 to propel ball 46 from its bail and towards the open mouth of cup 10.

Referring now to FIGS. 3 and 4, the other embodiment of the flexible game piece is shown with like structures giving corresponding reference numbers with the addition of the prime (') mark. The alternative or second flexible game piece 48' also has a base slat 50' with a spring 52' in the form of a bend towards the center of base slat 50'.

Instead of a post supporting portion as in the first embodiment of the flexible game piece, the second embodiment has a ball-engaging portion 62 that is manipulated in a manner similar to that for the first embodiment of flexible game piece 48. Ball-engaging portion 62 may also hold and support indicia in the form of a soccer player, hockey player, or the like. No post 56 is necessary as ball 46 is propelled across a flat surface rather than being hurled into the air.

As shown in FIG. 3, finger-gripping portion 64 may be held firmly between thumb T and fingers F of a first hand H. By holding finger-gripping portion 64 steady, a finger F' of another hand H', may engage ball-engaging portion 62, bending flexible game piece 48' back so that spring 52' flexes. When a ball 46 is located adjacent to ball-engaging portion 62, quick release of the ball-engaging portion allows it to strike ball 46, sending it forward and in a direction controllable by the player of the game. By aiming towards cup 10 resting upon its side, the player can strike ball 46 so that it rolls up the ramp provided by rectangular portion 32 of game board 16 and into the interior of cup 10.

As shown in FIG. 1, projectile ball 46 can be propelled into upright cup 10 and is aided into the cup by the backboard provided by square portion 18 of game board 16. As shown in FIG. 3, ball 46 can be directed into the interior of cup 10 by flexible game piece 48'.

As can be seen, a variety of table top game scenarios can be provided with game board 16, a cup 10 of sufficient size, and two flexible game pieces. Such variety of table top game playing scenarios enhances the possibilities of entertaining fun through the playing of table top games.

While the present invention has been described with regards to particular embodiments, it is recognized that additional variations of the present invention may be devised without departing from the inventive concept.

What I claim is:

1. A game of skill testing eye-hand coordination and manual dexterity, comprising:

a container, said container being selectively adapted to stand upright and to lay upon its side, said container having an open end, a closed end, and a containing wall;

a projectile, said projectile adapted to being propelled into and captured by said container;

a flexible game piece having first and second flat ends, each of said first and second flat ends being engageable by fingers of the hands of the players of said game, whereby said flexible game piece is adapted to propel said projectile into said container; and a game board, said game board having an array of inter-related slits formed therethrough, wherein said slits selectively engage said container both when said container is upright and when said container is on its side, said game board operating as a backboard when engaged upon said container when upright, said game board operating as a ramp when engaged upon said container when on its side.

2. The game of skill of claim 1, wherein said game board further comprises:

a first, generally square portion having a first tab with a first adjacent projection on one side of said first tab and second adjacent projection on another side of said first tab, said first tab adapted to fit inside the container, said first and second adjacent projections adapted to fit outside the container whereby said first, generally square portion may engage the rim of the container to attach the game board to the container;

a second, generally rectangular portion having a second tab with a third adjacent projection on one side of said second tab and a fourth adjacent projection on another side of said second tab, said second tab being adapted to fit inside the container, said third and fourth adjacent projections being adapted to fit outside the container whereby said second, generally rectangular portion may engage the rim of the container to attach the game board to the container;

said first tab oppositely opposing said second tab;

said first adjacent projection flexibly connected to said third adjacent projection; and said second adjacent projection flexibly connected to said fourth adjacent projection.

3. The game of skill of claim 2, wherein said first tab is adapted to hold said first portion upright when the container is in an upright position.

4. The game of skill of claim 2, wherein said second tab is adapted to hold a forward edge of said second portion against a supporting surface when the container is placed on a side to rest upon said supporting surface.

5. The game of skill of claim 1, wherein said flexible game piece comprises:

a finger-gripping portion, said first finger-gripping portion adapted to be held between at least one finger and a thumb of a first hand;

a projectile-engaging portion, said projectile-engaging portion adapted to propel said projectile away from said projectile-engaging portion, said projectile-engaging portion being adapted to be engaged by a finger of a second hand; and a flexible spring coupled to said finger-gripping portion and said projectile-engaging portion between said finger-gripping portion and said projectile-engaging portion, said flexible spring flexing when said finger-gripping portion is held steady and said projectile-engaging portion is pulled back, said flexible spring forcing said projectile-engaging portion to propel said projectile when said projectile-engaging portion is released by said finger of said second hand.

6. The game of skill of claim 5, wherein said finger-gripping portion, said projectile-engaging portion, and said flexible spring are integrally formed in a one-piece construction.

7. The game of skill of claim 6, wherein said flexible spring is a central C-shaped portion located between said finger-gripping portion and said projectile-engaging portion.

8. The game of skill of claim 1, wherein said flexible game piece comprises:

a finger-pressing portion, said finger-pressing portion adapted to be held between at least one finger and a steady surface below said finger-pressing portion;

a flexible spring coupled to said finger-pressing portion;

a post-supporting portion coupled to said flexible spring, said post-supporting portion adapted to be engaged by a second finger;

a post having first and second ends, said post projecting from said post-supporting portion at said first end, said post defining a first angle with respect to said post-supporting portion;

a circular bail coupled to said post at said second end of said post, said circular bail defining a plane having a second angle with respect to said post;

said circular bail adapted to propel said projectile away from said bail;

said flexible spring flexing when said finger-pressing portion is depressed by a first finger to engage a steady surface below said finger-pressing portion and said post-supporting portion is depressed by a second finger, said flexible spring forcing said post with its circular bail to propel said projectile resting within said circular bail when said post-supporting is released by said second finger.

9. The game of skill of claim 8, wherein said finger-pressing portion, said post-supporting portion, and said flexible spring are integrally formed in a one-piece construction.

10. The game of skill of claim 9, wherein said flexible spring is a central C-shaped portion located between said finger-pressing portion and said post-supporting portion.

11. The game of skill of claim 8, wherein said first angle defined between said post-supporting portion and said post is approximately sixty-five to eighty degrees (65°–80°).

12. The game of skill of claim 8, wherein said first angle is approximately seventy-three degrees (73°).

13. The game of skill of claim 8, wherein said second angle defined between said post and said circular bail is approximately sixty to seventy-five degrees (65°–70°).

14. The game of skill of claim 8, wherein said second angle is approximately sixty-seven degrees (67°).

* * * * *